US005579620A

United States Patent [19]

Kuo

[11] Patent Number: 5,579,620

[45] Date of Patent: Dec. 3, 1996

[54] WALL SYSTEM

[76] Inventor: Ching-Liang Kuo, No.90-1, Pao-An Rd., Yung-An Hsiang, Kaohsiung Hsien, Taiwan

[21] Appl. No.: 205,247

[22] Filed: Mar. 3, 1994

[51] Int. Cl.[6] ..... E04B 1/16; E04B 2/84

[52] U.S. Cl. ..... 52/447; 52/220.3; 52/414; 52/454; 52/576

[58] Field of Search ..... 52/220.2, 220.3, 52/220.4, 796, 797, 798, 807, 414, 344, 352, 443, 444, 447, 450, 300, 576, 577, 344, 383, 380, 381, 382, 220.5, 449, 451, 452, 454

[56] References Cited

U.S. PATENT DOCUMENTS

| | | | |
|---|---|---|---|
| 1,116,185 | 11/1914 | White | 52/451 |
| 1,538,681 | 5/1925 | Buckhout | 52/382 |
| 1,785,067 | 12/1930 | Bemis | 52/381 |
| 3,564,799 | 2/1971 | Hanson | 52/454 |
| 3,611,451 | 10/1971 | Armstrong | 52/220.2 |

FOREIGN PATENT DOCUMENTS

| | | | |
|---|---|---|---|
| 1232488 | 10/1960 | France | 52/314 |
| 361490 | 11/1931 | United Kingdom | 52/451 |

*Primary Examiner*—Michael Safavi

*Attorney, Agent, or Firm*—Jacobson, Price, Holman & Stern, PLLC

[57] ABSTRACT

A wall system includes one or more wall members, and a number of retaining devices fixed to columns or posts and engaged with the wall members for retaining the wall member in place. The wall member includes a number of beams each having a hollow interior, and a number of intermediate ribs formed between the beams so as to solidly couple the beams together. An outer layer of can be formed on the outer peripheral portion of the wall member and engaged with the openings of the intermediate ribs so as to form a smooth outer appearance.

3 Claims, 8 Drawing Sheets

WALL SYSTEM

BACKGROUND OF THE INVENTION

1. Field of the Invention

The present invention relates to a wall system, and more particularly to a wall system having a novel configuration.

2. Description of the Prior Art

Typically, wall systems are formed by bricks, or formed by molding processes, i.e., building, with wood boards, a mold cavity having a shape corresponding to that of the wall systems, and pouring concrete into the mold cavity in order to form the wall system, the wall systems are suitable for building houses only.

Recently, huge buildings are built with steel construction, mold boards are then fixed around the steel construction, and concrete is then engaged in the mold cavity formed by the mold boards, it is also complicated to build the mold boards.

The present invention has arisen to mitigate and/or obviate the afore-described disadvantages of the conventional wall systems.

SUMMARY OF THE INVENTION

The primary objective of the present invention is to provide a wall system which can be easily constructed.

In accordance with one aspect of the invention, there is provided a wall system for being constructed in supporting means comprising at least one wall member including two side portions, and retaining means secured to the supporting means for retaining the wall member in place.

The wall member includes a plurality of beams each having a hollow interior formed therein, and a plurality of intermediate ribs formed between the beams so as to solidly couple the beams together. Each of the intermediate ribs includes a plurality of openings formed therein, the wall system further comprises an outer layer secured to the wall member and engaged with the openings of the intermediate ribs. The wall member includes a plurality of brackets engaged with the openings for supporting rods.

Each of the beams includes two open ends, and a plug engaged with each of the open ends of the beams so as to enclose the beams, the plug includes an aperture formed therein for inserting tubes or electric wires.

The wall member includes two side ribs each having a plurality of orifices formed therein, the wall system further comprises an outer layer secured to the wall member and engaged with the orifices of the side ribs.

The wall member includes a plurality of tubes connected between the beams so as to communicate the hollow interiors of the beams with one another.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
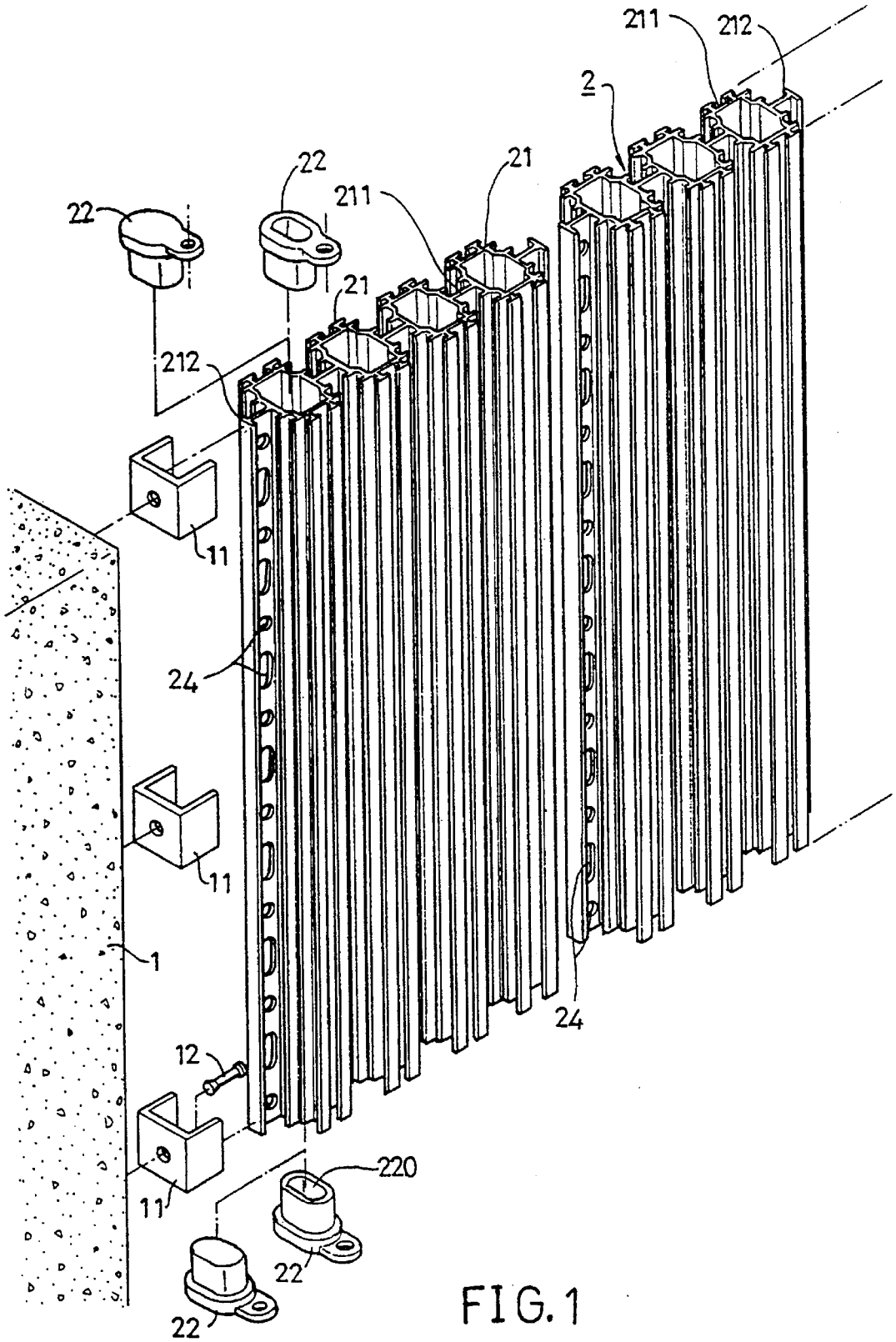
FIG. 1 is a partial exploded view of a wall system in accordance with the present invention.
Figure 2:
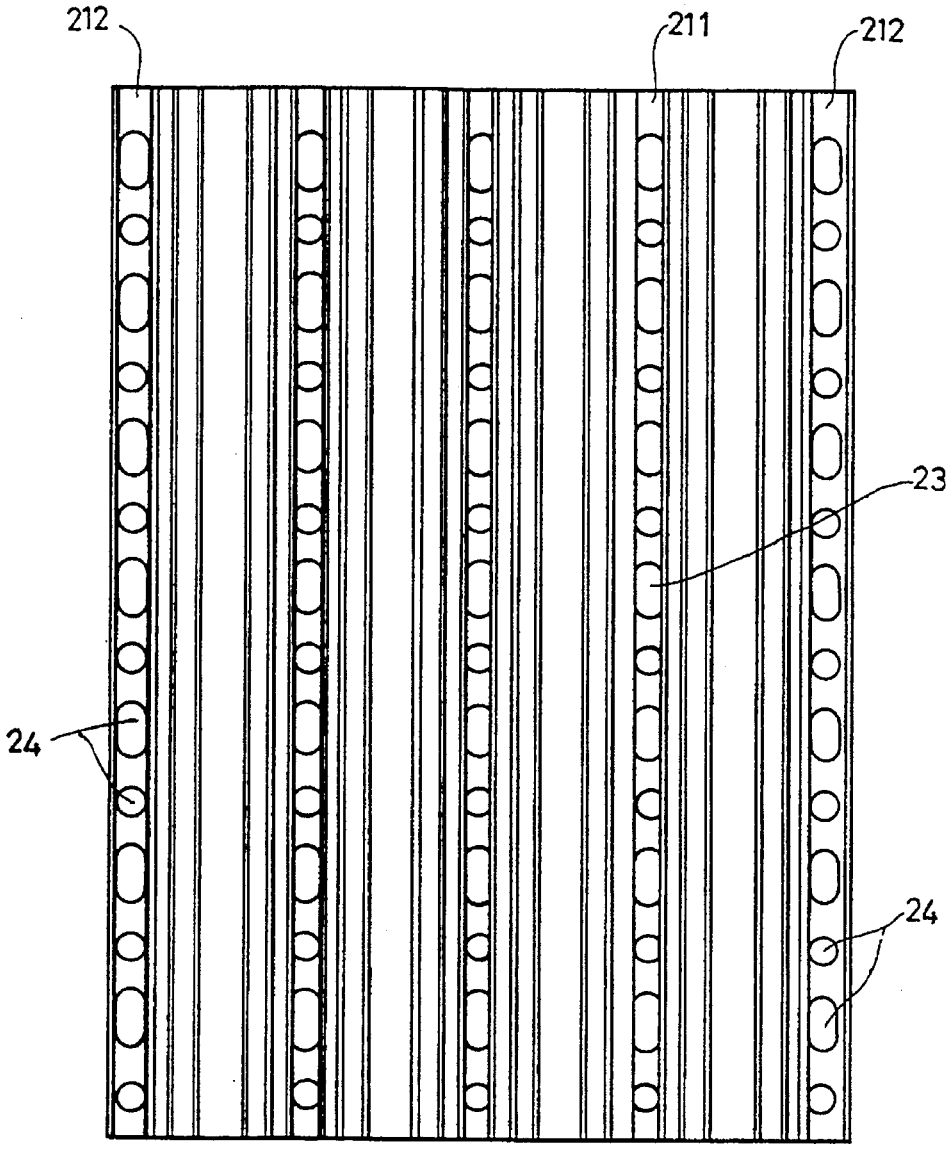
FIG. 2 is a plane view of the wall member.
Figure 3:
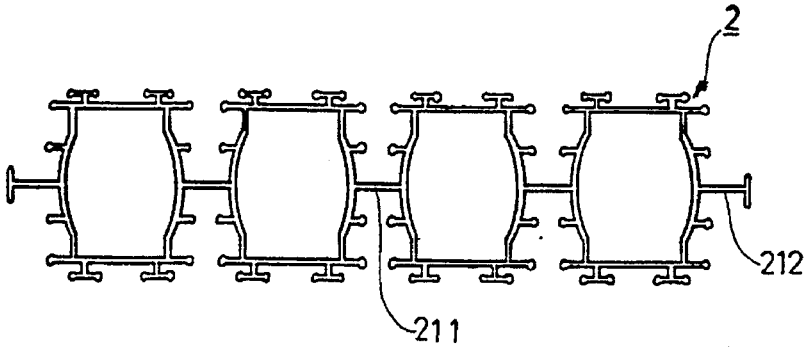
FIG. 3 is a cross sectional view of the wall member.
Figure 4:
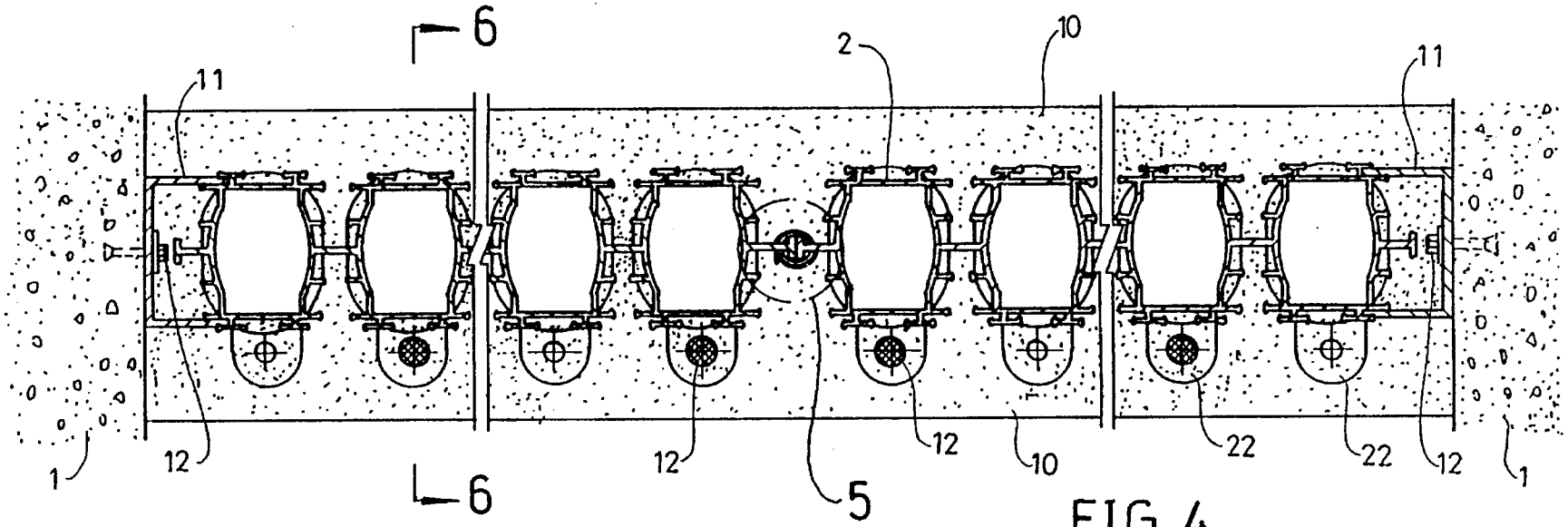
FIG. 4 is a cross sectional view of the wall system.
Figure 5:
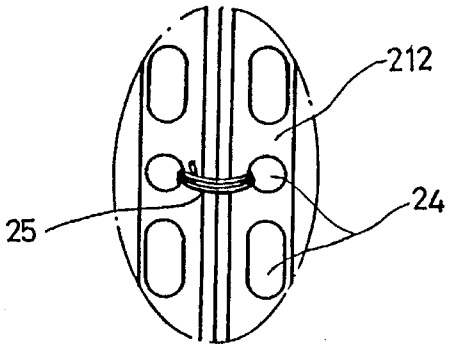
FIG. 5 is an enlarged schematic view illustrating portion of the wall system.
Figure 6:
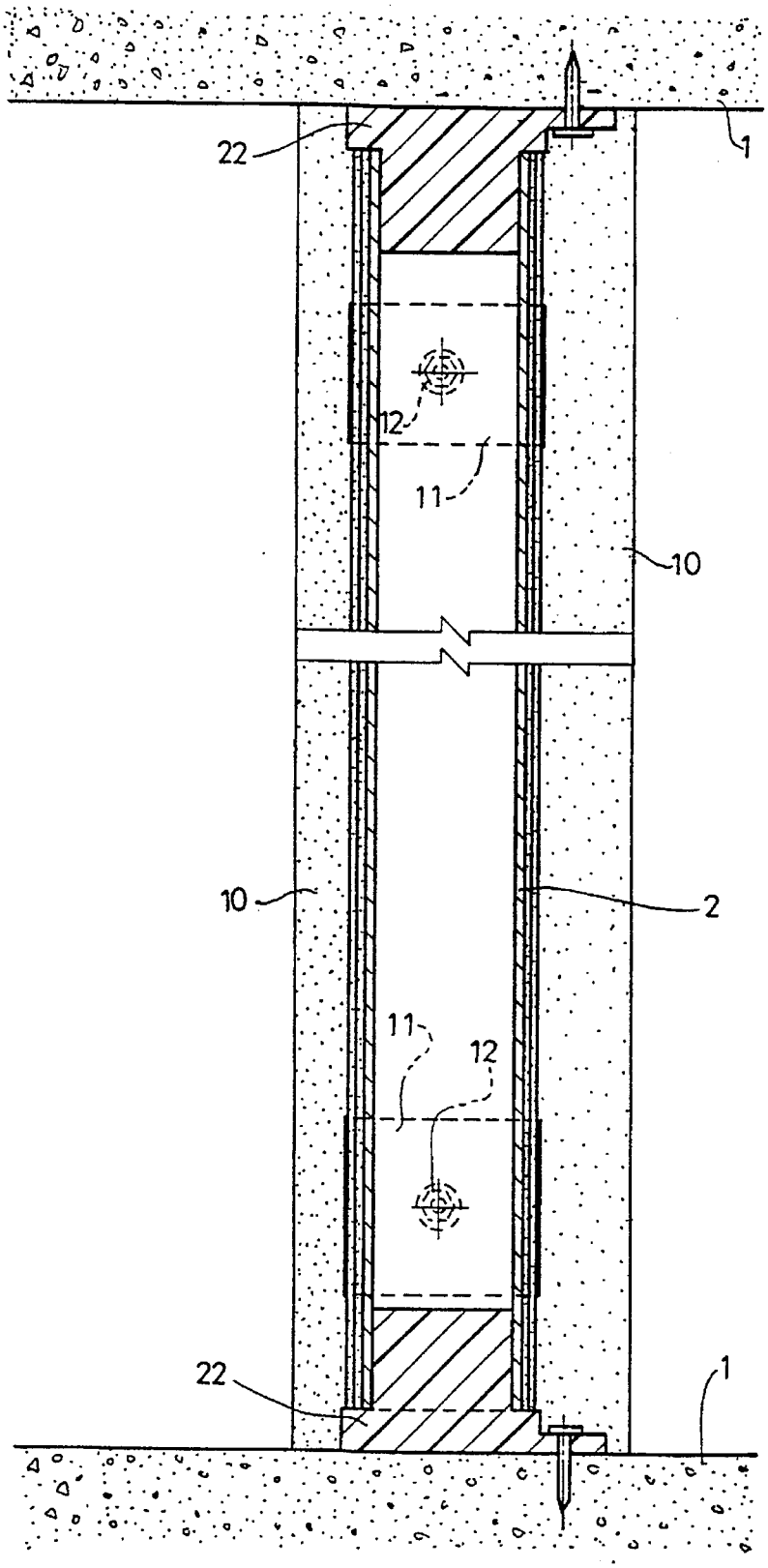
FIG. 6 is a cross sectional view taken along lines 6—6 of FIG. 4.

Referring to the drawings, and initially to FIGS. 1 to 6, a wall system in accordance with the present invention comprises a number of retaining members 11 fixed, by screws 12, to supporting means 1, such as column, ceiling or floor, best shown in FIG. 6, in order to engage with wall members 2, such that the wall members can be stably retained in place by the retaining members 11, the wall members 2 can be made with plastic materials, metal or steel materials or other construction materials, and can be made to different sizes, each of the wall members 2 includes a number of beams 21 each having a hollow interior formed therein and each having two open ends enclosed by plugs 22, the plugs 22 may be formed with an aperture 220 for threading electric wires or tubes, the beams 21 form the primary construction of the wall system and are secured together by intermediate ribs 211 each having a number of openings 23 formed therein, each of the wall members 2 includes two side ribs 212 each having a number of orifices 24 formed therein, as shown in FIGS. 4 and 5, the wall members 2 can be secured together by wires 25 which are threaded through the orifices 24 formed in the side ribs of the wall members 2. A number of reinforcing ribs are formed on the outer peripheral portions of the beams 21.

As shown in FIG. 4, the wall system includes one or more wall members 2 secured together, and an outer layer 10 of concrete material having a thickness close to 1.5 cm, the concrete material is sprayed or injected onto the wall members 2 with a rate close to 20 l/min, or 1200 l/hr, such that 80 $m^2$ of the outer layer 10 can be formed within one hour, the concrete material can be dried within 60 minutes, and can be cured within 120 minutes. The concrete material on both sides of the wall members 2 are solidly secured together via the openings 23 and the orifices 24. In order to increase sound shielding effect and the heat resistive effect, foamable materials or other heat resistive material may be injected into the hollow interior of the beams 21.

Figure 7:
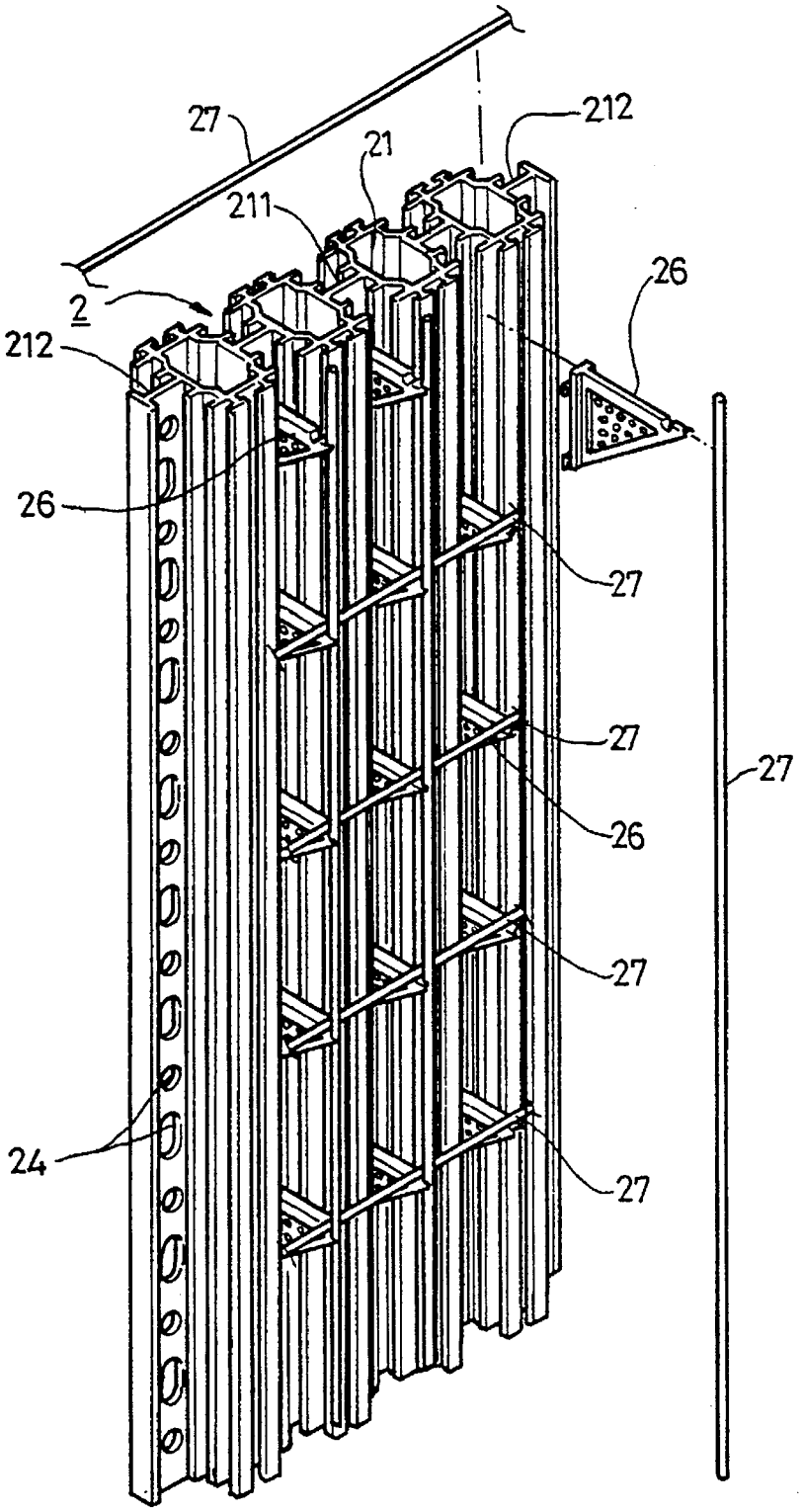
FIGS. 7, 8 and 9 are schematic views illustrating three applications of the wall system.

Referring next to FIG. 7, a number of brackets 26 can be hung on the wall members 2 with the openings 23 of the wall members 2, and a number of steel rods 27 can be retained in place by the brackets 26 so as to reinforce the wall system.

Figure 8:
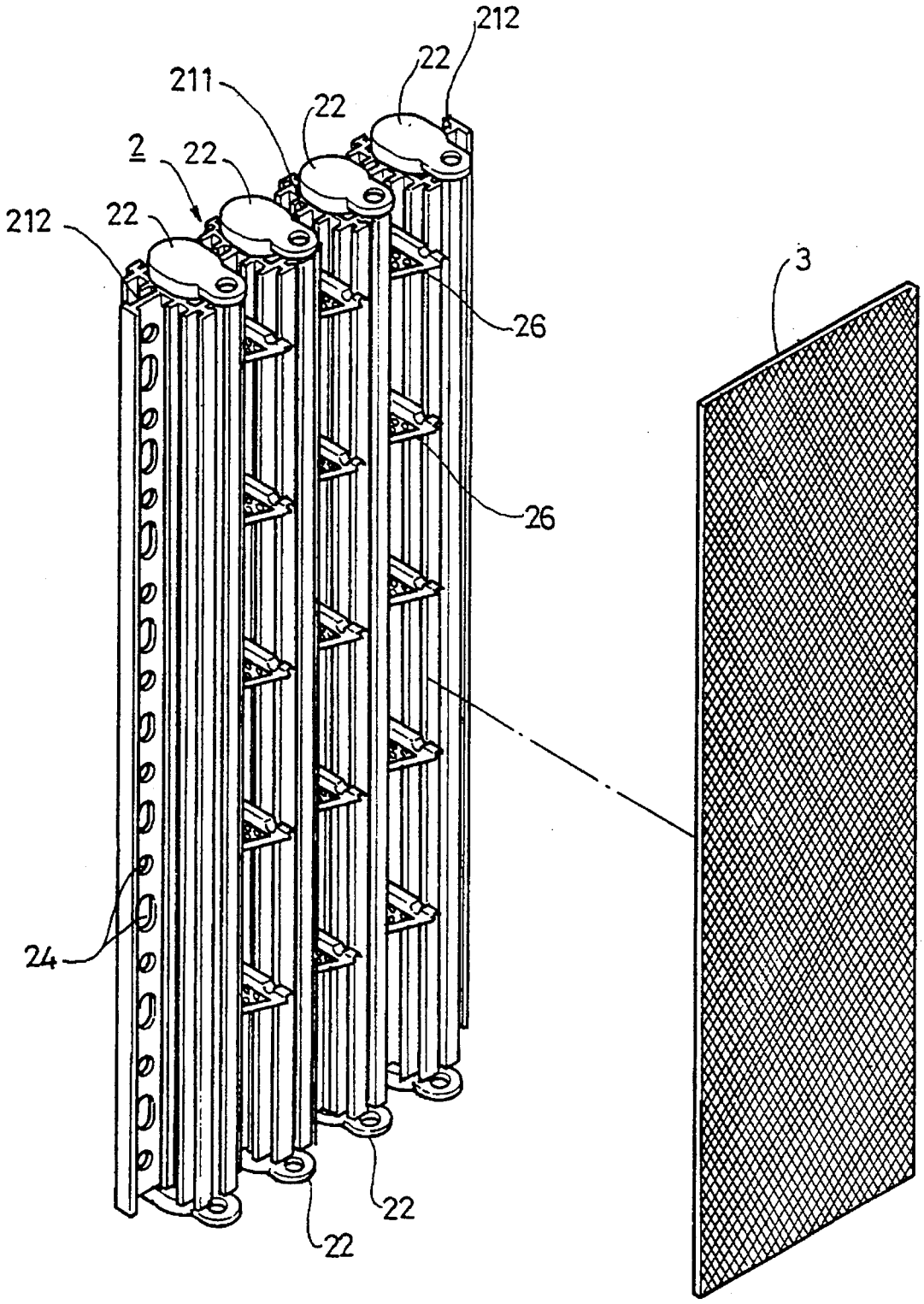

Referring next to FIG. 8, instead of the steel rods 27 as shown in FIG. 7, a net member 3 can be secured to the wall member 2 by the brackets 26 which include tips for supporting the net member 3.

Figure 9:
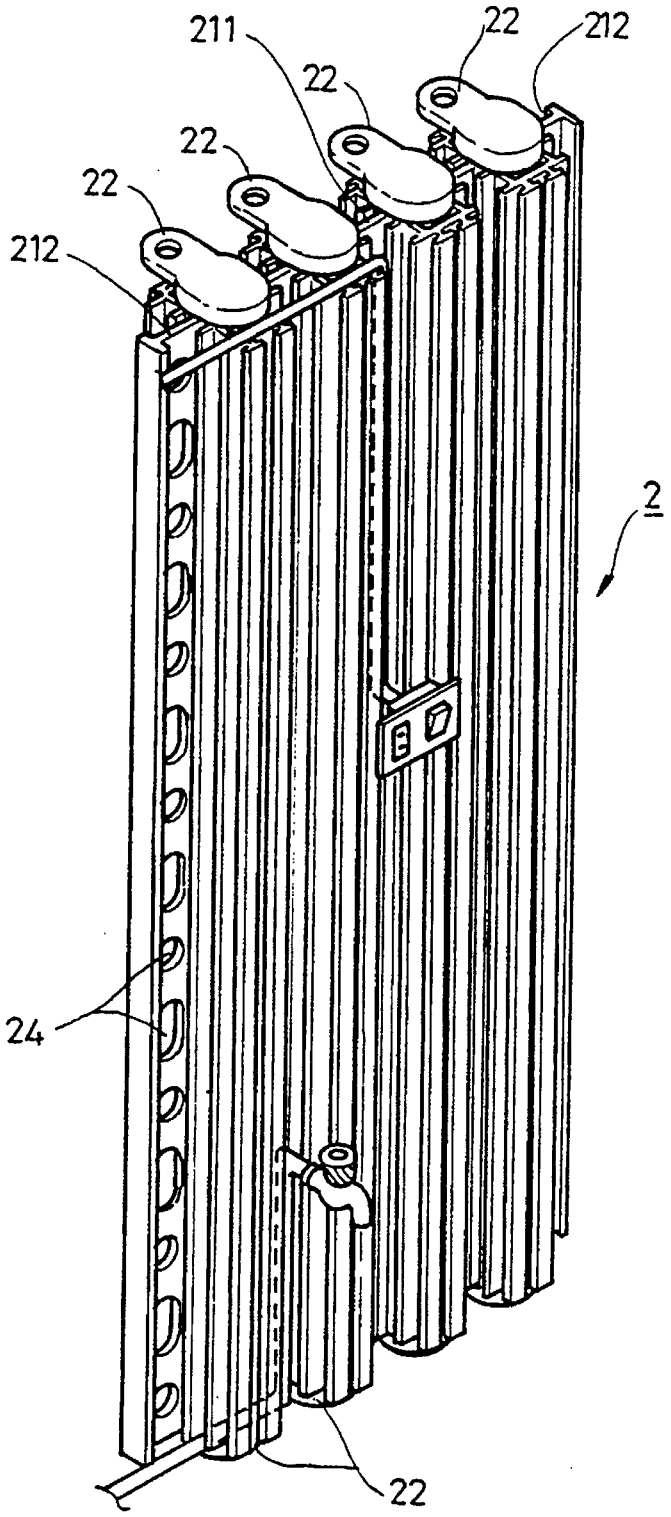

Referring next to FIG. 9, illustrated is an application of the tubes and electric wires can be installed within the beams.

Figure 10:
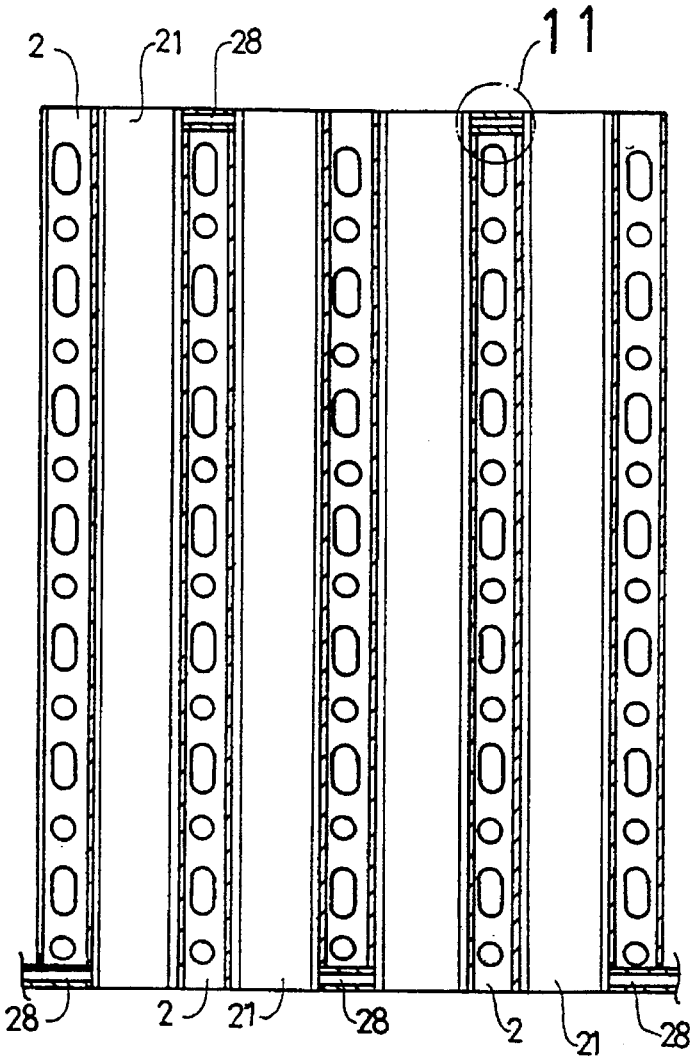
FIG. 10 is a front view illustrating another application of the wall system.
Figure 11:
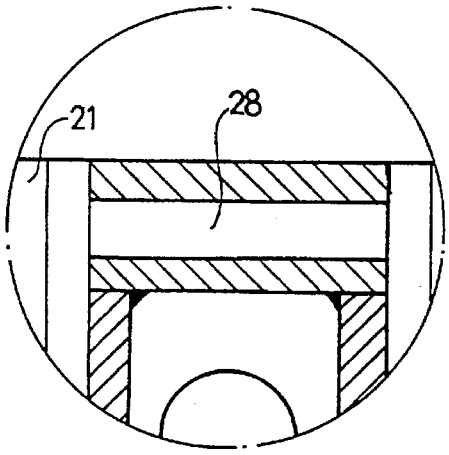
FIG. 11 is an enlarged view illustrating portion of the wall system as shown in FIG. 10.

Referring next to FIG. 10, a number of pipes 28 can be provided to communicate the hollow interiors of the beams 21 together, such that, if required, warm air may be injected into the wall members 2 and may flow through the beams 21 via the pipes 28, so as to warm the wall system during winter.

Accordingly, the wall system in accordance with the present invention includes a greatly simplified configuration which can be easily constructed.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wall system for connection to a supporting means, said wall system comprising at least one wall member having a plurality of integrally formed beams each having a hollow interior formed therein, and retaining means for securely engaging said supporting means so as to retain said at least one wall member in place, wherein said at least one wall member includes two side ribs, each having a plurality of orifices formed therein and extending completely through said side ribs from one surface of the side ribs to an opposite surface of the side ribs, said at least one wall member further comprising a plurality of external reinforcing ribs extending outwardly from an outside surface of each of said integrally formed beams, said wall system further comprising an outer layer secured to said wall member and engaged with said orifices of said side ribs, wherein said outer layer comprises a solidifiable material which extends through said orifices, and becomes secured, after solidification, to said at least one wall member through said orifices.

2. The wall system according to claim 1, wherein said at least one wall member further comprises a plurality of beams, each having a hollow interior formed therein, and a plurality of intermediate ribs formed between said beams so as to solidly couple said beams together.

3. The wall system according to claim 2, wherein each of said intermediate ribs includes a plurality of openings formed therein, and wherein said outer layer is also engaged with said plurality of openings.

* * * * *